US011401010B2

(12) United States Patent
Peterson

(10) Patent No.: US 11,401,010 B2
(45) Date of Patent: Aug. 2, 2022

(54) UNDERWATER DATA CAPTURE AND TRANSMISSION SYSTEM HAVING A VARIABLE BUOY

(71) Applicant: Continental Shelf Associates, Inc., Stuart, FL (US)

(72) Inventor: Kevin Clyde Peterson, Stuart, FL (US)

(73) Assignee: Continental Shelf Associates, Inc., Stuart, FL (US)

( * ) Notice: Subject to any disclaimer, the term of this patent is extended or adjusted under 35 U.S.C. 154(b) by 33 days.

(21) Appl. No.: 17/060,515

(22) Filed: Oct. 1, 2020

(65) Prior Publication Data

US 2021/0101661 A1 Apr. 8, 2021

Related U.S. Application Data

(60) Provisional application No. 62/910,087, filed on Oct. 3, 2019.

(51) Int. Cl.
*B63B 22/20* (2006.01)
*B63B 22/00* (2006.01)

(52) U.S. Cl.
CPC ..... *B63B 22/20* (2013.01); *B63B 2022/006* (2013.01); *B63B 2203/00* (2013.01); *B63B 2207/02* (2013.01); *B63B 2211/02* (2013.01)

(58) Field of Classification Search
CPC ..... B63B 22/20; B63B 2022/006; B63B 2203/00; B63B 2207/02; B63B 2211/02
See application file for complete search history.

(56) References Cited

U.S. PATENT DOCUMENTS 5,311,272 A * 5/1994 Daniels ..... G01S 17/89 356/342
10,703,445 B2 * 7/2020 Oscarsson ..... G01V 3/15
2011/0259096 A1 * 10/2011 Earle ..... G01W 1/08 73/170.16
2021/0072094 A1 * 3/2021 Greenfield ..... G01K 1/022

FOREIGN PATENT DOCUMENTS

WO WO-2017147565 A2 * 8/2017 ..... A01M 29/16

* cited by examiner

*Primary Examiner* — S. Joseph Morano
*Assistant Examiner* — Jovon E Hayes
(74) *Attorney, Agent, or Firm* — Duane Morris LLP

(57) ABSTRACT

An underwater data capture and transmission system has a base configured to sink in water, at least one sensor configured to capture data while submerged in water, a processing unit configured to receive data collected by the sensor, and a variable buoy. The variable buoy has a ballast system configured to adjust a depth of the variable buoy in the water, and a communication device configured to transmit data to a remote communications device. The system further has at least one tether connecting at least the base, the processing unit, and the variable buoy.

20 Claims, 4 Drawing Sheets

UNDERWATER DATA CAPTURE AND TRANSMISSION SYSTEM HAVING A VARIABLE BUOY

CROSS-REFERENCE TO RELATED APPLICATIONS

This application claims priority to U.S. Provisional Patent Application No. 62/910,087, filed on Oct. 3, 2019, which is herein incorporated by reference in its entirety.

TECHNICAL FIELD

This application relates generally to data capture and transmission, and, more particularly, to an underwater data capture and transmission system having a variable buoy.

BACKGROUND

Underwater data acquisition systems can be deployed from vessels of opportunity to collect remote underwater sensor data. Such systems do not require permanent infrastructure for deployment or operation. However, the cost and effort associated with collecting deep water data from the sensors of such systems can be expensive and problematic. One example is the use of surface buoys as transmission devices. However, there are several drawbacks to using data devices that float at the ocean surface. For example, one of the primary cost drivers is the design of a system that is required to withstand severe weather, high waves and wind, strong ocean currents and other environmental exposure on the surface of the open ocean. There is also an increasing risk of vandalism, theft and unintentional collisions of surface buoys due to increased shipping, fishing and piracy activities across the oceans. Further, surface buoys become encrusted with marine growth as they sit on the surface for long periods of time The present disclosure is directed to overcoming these and other problems of the prior art.

SUMMARY

In an embodiment, the present disclosure is directed to an underwater data capture and transmission system. The system includes a base configured to sink in water, at least one sensor configured to capture data while submerged in water, a processing unit configured to receive data collected by the sensor, and a variable buoy. The variable buoy includes a ballast system configured to adjust a depth of the variable buoy in the water, and a communication device configured to transmit data to a remote communications device. The system further includes at least one tether connecting at least the base, the processing unit, and the variable buoy.

In other embodiments, the present disclosure is directed to a variable buoy. The variable buoy includes a controller configured to execute software instructions, a memory device in communication with the controller, the memory device configured to store data collected from one or more sensors, and a communications device in communication with the controller and configured to transmit the data to a remote location. The variable buoy further includes a ballast system configured to adjust a depth of the variable buoy in the water, a power supply for providing power to the controller, the communications device, and the ballast system, and a connector configured to connect the variable buoy to a tether for anchoring the variable buoy and receiving the data collected from the one or more sensors.

BRIEF DESCRIPTION OF THE DRAWINGS

Various exemplary embodiments are described in detail below with reference to the following Figures. The drawings are provided for purposes of illustration only and merely depict exemplary embodiments. These drawings are provided to facilitate the reader's understanding of the embodiments and should not be considered limiting of the breadth, scope, or applicability of the disclosure. It should be noted that for clarity and ease of illustration these drawings are not necessarily drawn to scale.

DETAILED DESCRIPTION

Figure 1:
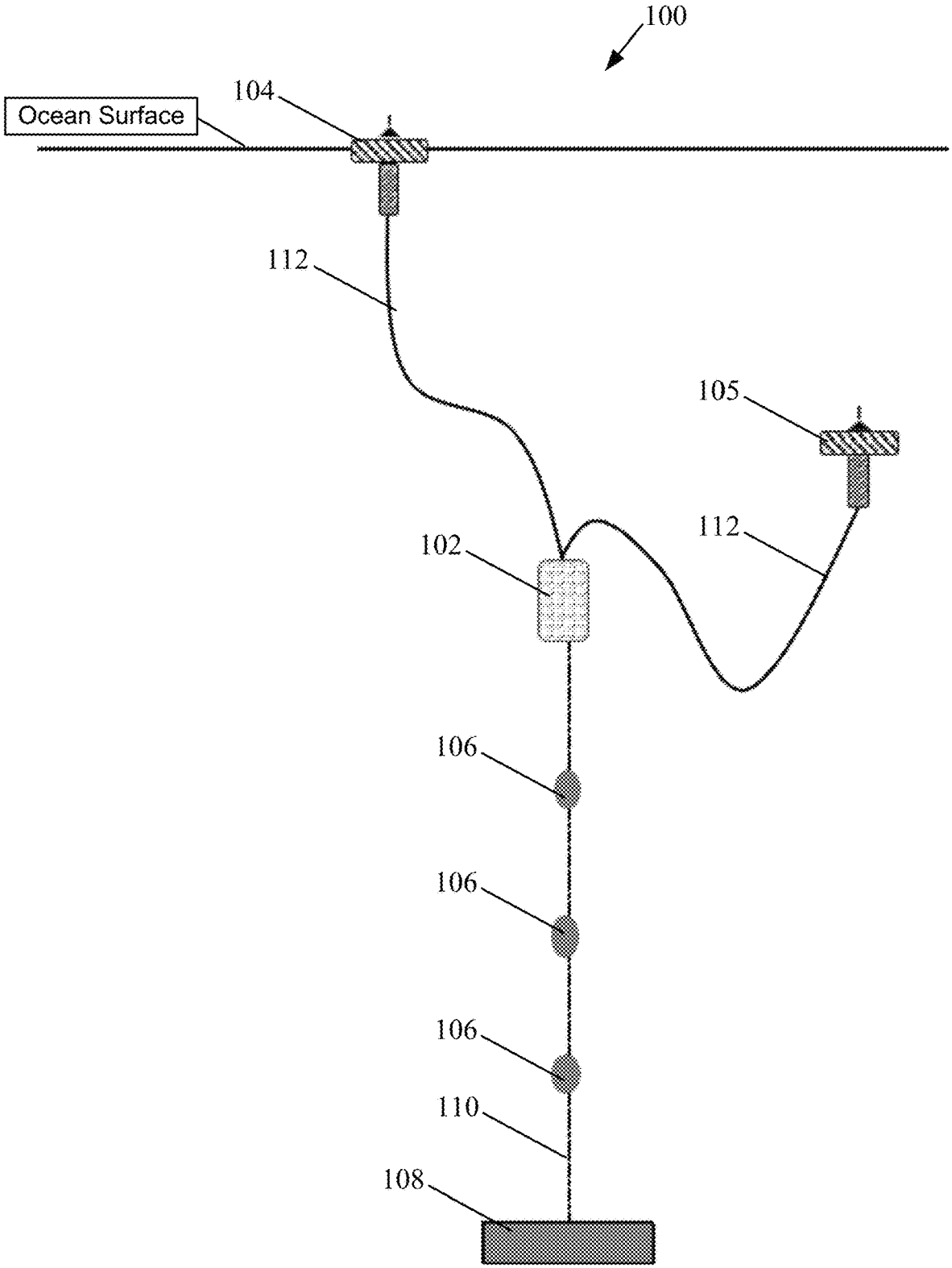
FIG. 1 is a diagram of an exemplary underwater data capture and transmission system, in accordance with various embodiments.

This description of embodiments is intended to be read in connection with the accompanying drawings, which are to be considered part of the entire written description. The drawing figures are not necessarily to scale and certain features of the invention may be shown exaggerated in scale or in somewhat schematic form in the interest of clarity and conciseness. In the description, relative terms such as "horizontal," "vertical," "up," "down," "top," and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively or operably connected" is such an attachment, coupling or connection that allows the pertinent structures to operate as intended by virtue of that relationship.

A Sea to Satellite-Variable Buoy (STSVB) system described herein is designed to lower the risks of damage during weather and environmental events, avoid shipping and fishing activities, avoid vandalism and theft and reduce marine growth by removing the buoy from harm's way when it detects any number of preset parameters from various onboard sensors or instructed by onboard software routines. Onboard sensors can include various instruments such as, for example, acoustic hydrophones, wave action sensors, current meters, accelerometers, pressure sensors, magnetometers, and other sensors capable of detecting environmental conditions and approaching vessels, to list only a few possibilities. In some embodiments, the STSVB can be remotely controlled via a satellite connection from its home base onshore, either manually or automatically with input from a variety of Remote Sensing devices such as Satellite or Aerial Surveillance, Marine Automatic Identification Systems (AIS), Radar, other Surface Buoy systems, Seabed Systems, or other shore based or remote sensors.

FIG. 1 is a diagram of an exemplary STSVB system 100 in accordance with some embodiments. System 100 may include a primary processing unit (PPU) 102, a first variable buoy 104, a second variable buoy 105, one or more sensors 106, a base 108, an anchoring tether 110, and umbilical tethers 112. One of ordinary skill in the art will understand that system 100 may include any number of PPUs 102, variable buoys 104, 105, sensors 106, bases 108, and tethers 110, 112, depending on the needs and requirements of the system.

The system 100 may include one or more variable buoys 104, 105. The disclosed system 100 includes variable buoy 104 shown at the water surface and variable buoy 105 submerged to a selected depth. The variable buoys 104, 105 may otherwise be identical or at least include similar components to each other for receive data collected by the sensors 106 and transmitting the data external to the system 100. The variable buoys 104, 105 may include a buoyancy system (as will be described in more detail) to control a depth at which the variable buoy sits in the water. The variable buoys 104, 105 may be connected to the PPU by the umbilical tethers 112

The system 100 may include any appropriate type of sensors 106 and may include multiple sensors 106 of the same type as well as combinations of different types of sensors 106. For example, the system 100 may include oceanographic sensors—such as conductivity sensors, temperature sensors, pressure sensors, depth sensors, turbidity sensors, dissolved oxygen sensors, current sensors, water level sensors, tsunami sensors, optics and various other analog and digital instruments. The system 100 may also include sensors 106 for gathering acoustic data—such as sensors configured for passive acoustic monitoring, detection of mammals, detection of vessel traffic, and/or surveillance. The system 100 may also include sensors 106 configured for subsea communications monitoring—such as sensors configured to provide a cable status indication, node monitoring, and/or security.

The plurality of sensors 106 may be configured for underwater data collection. The plurality of sensors 106 may be spaced from each other along the first tether 110 to collect data at different locations (e.g., different ocean depths). The sensors 106 may be configured to generate a signal indicative of a monitored parameter (e.g., pressure, flow rate, presence or absence of a material or compound, to list only a few non-exclusive examples). In some embodiments, one or more of the sensors 106 may be image capture devices configured to capture image data. The sensors 106 may be configured to transmit data to the variable buoys 104.

The base 108 may include a weighted component configured to anchor the sensors 106 and the tether 110 to locations under the water. The base 108 may be configured as a stationary component configured to maintain the PPU 102 and sensors 106 in a general area under the water. In some embodiments, the base 108 may be configured for remote control to move the base 108 to another location on the ocean floor. For example, the base may include wheels and/or ballast system to assist in moving the base 108 from one location to another on the ocean floor.

The base 108 may be configured such that it can release the tether 110 to allow the PPU 102, variable buoys 104, 105 sensors 106, and/or tethers 112 to float to the surface where they can be recovered. For example, in one embodiment, the base 108 is configured to release the tether 110 based on an acoustic signal. In such embodiments, the base 108 may include an acoustic release or burn wire. For example, an acoustic signal may be sent from a vessel to the system 100 to trigger release of the tether 110. In response to receipt of the acoustic signal, the base 108 releases the tether 110, thereby allowing the PPU 102, variable buoys 104, 105, sensors 106, and/or tethers 112 to float toward surface while leaving the base 108 on the sea floor. Upon release, or upon surfacing, the PPU 102 may transmit a datagram containing information regarding its geographic position to allow it to be tracked and located. For example, the PPU 102 may transmit Iridium Short Burst Data (SBD) transmissions.

The tether 110 may be fabricated from a strong and durable material to form a reliable connection between the base 108, sensors 106, and PPU 102. The tether 110, in some embodiments, may be and/or include data transmission capability between the sensors 106 and the PPU 102. For example, the tether 110 may include a data transmission wire to enable the sensors 106 to transmit data to the PPU 102 and the variable buoys 104, 105. The umbilical tethers 112 may similarly include data transmission capability, such as to transmit data from the PPU 102 to the variable buoys 104, 105.

Figure 2:
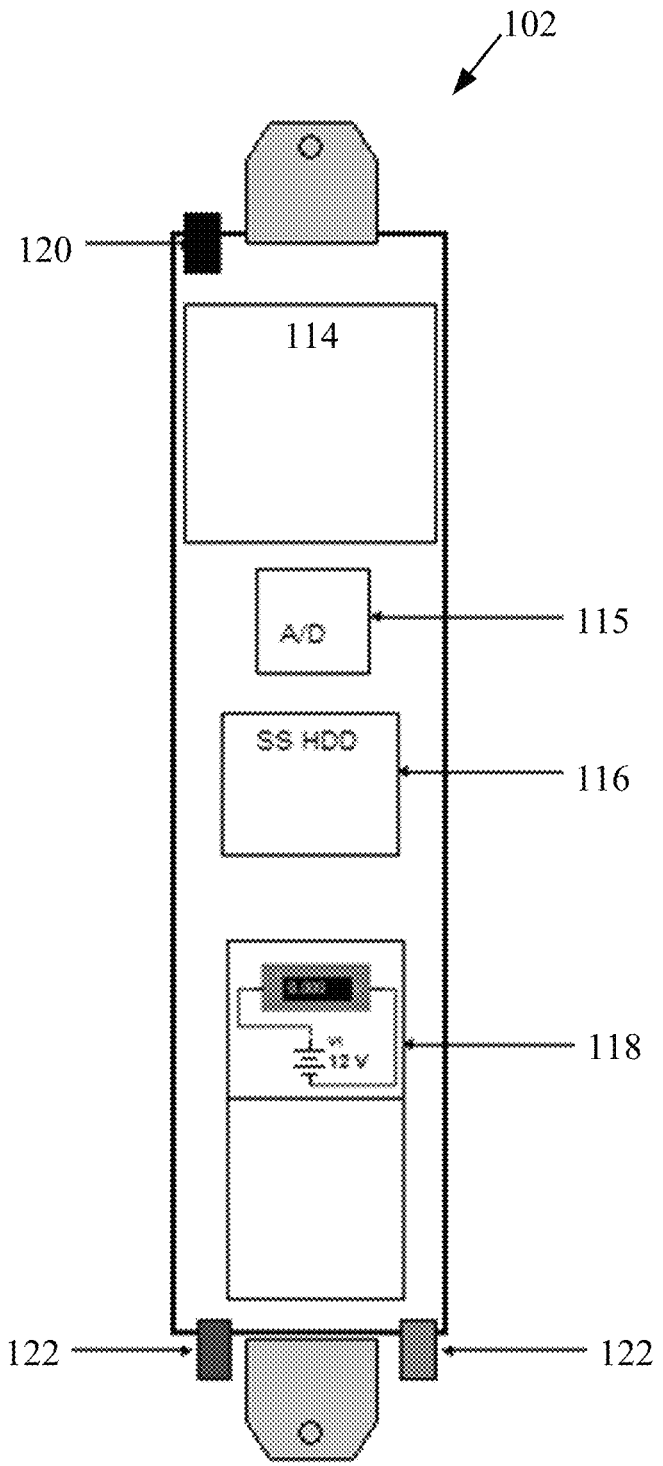
FIG. 2 is a block diagram of an exemplary processing unity for the underwater data capture and transmission system of FIG. 1, in accordance with various embodiments.

FIG. 2 is a block diagram of an exemplary embodiment of the PPU 102 in accordance with some embodiments. As illustrated in FIG. 2, the PPU 102 may include an embedded controller 114, an analog-to-digital converter 115, a master data storage module 116, a battery or other power supply 118. The PPU 102 may also include a connector 120 for connecting to the umbilical tether 112. The connector 120 may include a data connection enabling data transfer via the tether 112 from the controller 114 to one or more of the variable buoys 104, 105.

The controller 114 may be, for example, a microcontroller (e.g., a single board computer), although one of ordinary skill in the art will understand that the controller may include a plurality of microcontrollers or other suitable control electronics. The data storage module 116 may be any appropriate memory device, such as, for example, a solid state hard drive.

In some embodiments, the PPU 102 may further include on-board sensors 122. The on-board sensors 122 may include, for example, a pressure transducer, a hydrophone, etc. The on-board sensors 122 may be configured to monitor acoustic activity including vessel traffic and biologicals, as well as monitor the surrounding conditions in the water column as well as conditions inside of the PPU 102.

The PPU 102 may be configured to handle all communications and power distribution to the sensors 106 and data transmission via the variable buoys 104, 105. In some embodiments, the PPU houses the power supply 118 to effectively store and distribute power to systems and subsystems, such as the variable buoys 104, 105. The PPU 102 may be configured to monitor all peripheral power ensuring no external system can draw excess voltage/current. The PPU 102 may be designed to reduce power consumption during periods where renewable power sources have been offline for long periods of time due to extended surface weather events or system failures, and provide emergency power backup to ensure secure data storage and system recall to the surface for maintenance and retrieval.

In some embodiments, the PPU 102 connects to sensors 106 that may be deployed on a mooring array and hardwired back to the PPU 102, or connected via acoustic links to other sensors deployed on the seabed, as well as sensors deployed on other arrays, or sensors connected to the PPU 102 via a hardwired fiber optic or copper connection to ocean observatory assets and nodes. Data from all sensors, internal and external, may be received by the PPU 102, processed, stored and transmitted as directed via the satellite link in the SB or hardwired link to a seabed fiber optic cable system.

The PPU 102 may also be configured to provide controlling instructions to the variable buoys 104, 105 to control a position/depth of the variable buoys 104, 105 depending on one or more conditions. For instance, the PPU 102 may be configured to execute a data transfer process in which the controller 114 instructs the variable buoy 104 to travel to the water surface and transmit data to a receiving device (e.g., via satellite or other wireless network connection). In another example, the PPU 102 may be configured to execute a buoy safety process in which the controller 114 instructs the variable buoy 105 to fall to a depth below the water surface such that it is out of the way of potential harm (e.g., weather, oncoming vessels, etc.). In some embodiments, the PPU 102 may execute a safety process based on conditions detected by one or more of the on-board sensors 122. For example, the on-board sensors 122 may detect a weather condition or oncoming vessel and instruct the variable buoy 104 or 105 to travel to a safe depth. The controller 114 may provide such instructions via a data connection, such as a wired connection established by the umbilical tether 112.

Figure 3:
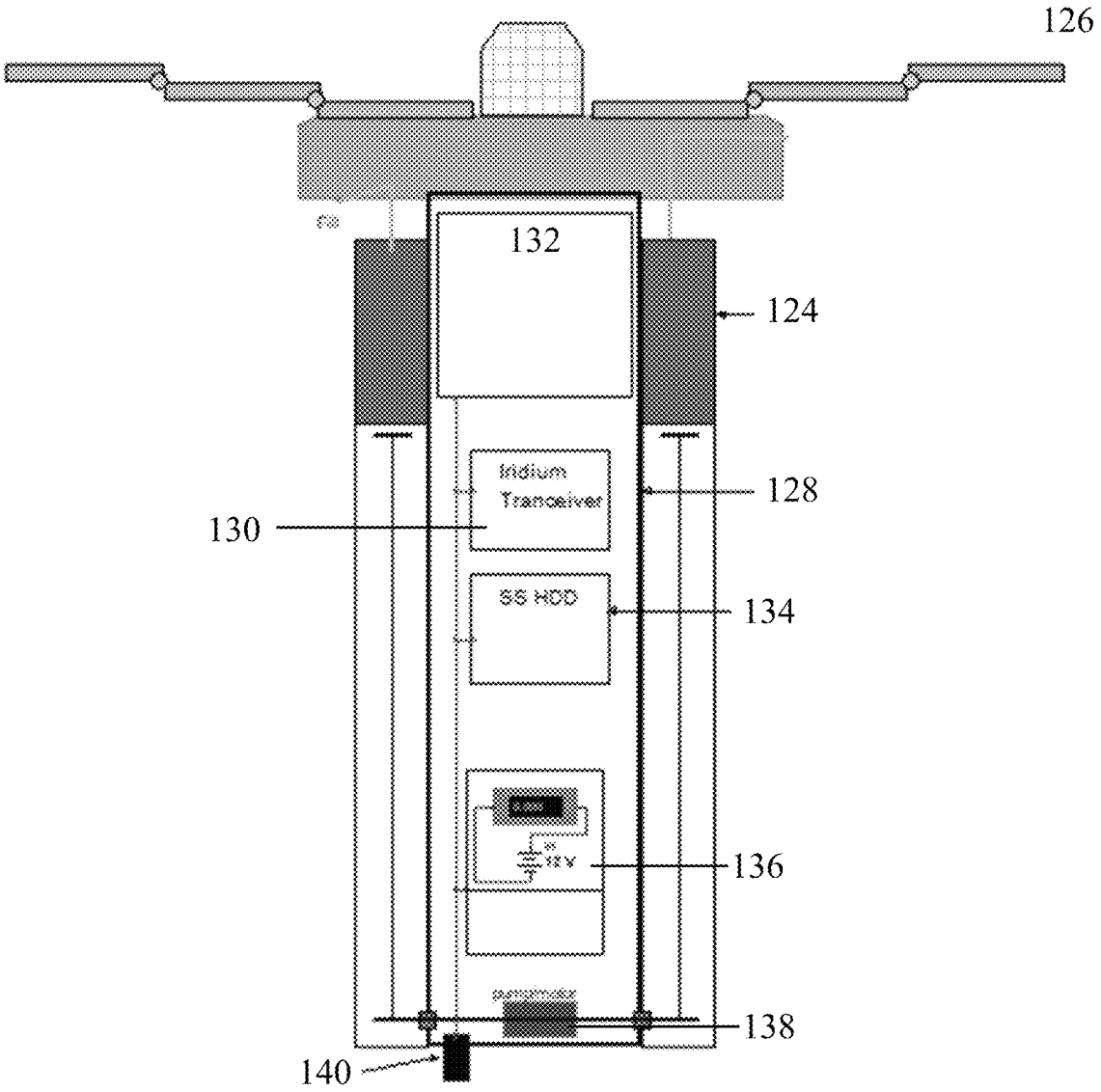
FIG. 3 is a block diagram of an exemplary variable buoy, in accordance with various embodiments.

FIG. 3 is a block diagram of an exemplary variable buoy 104. While the description relates to variable buoy 104, it should be understood that the features, components, and function may equally apply to the variable buoy 105. In some embodiments, the variable buoy 104 includes a ballast system 124 that provides the ability to submerge or surface on command. The ballast system 124 controls the pumping or movement of fluid and/or gas into and out of ballast tanks onboard the variable buoy 104, thereby changing the buoyancy of the variable buoy 104. The type of fluid or gas, as well as the volumes, may be selected based on, for example, the design payload of the variable buoy 104 and the desired depth of deployment as will be understood by a person of ordinary skill in the art. The ballast system 124 may also include, for example, a syntactic float configured to cause the variable buoy 104 to ascend in water absent a countervailing force produced by the ballast system 124 (e.g., by moving fluid into or out of the ballast tanks). The variable buoy 104 is configured to receive instructions regarding a desired depth and control the ballast system 124 to move the variable buoy 104 to the desired depth.

The variable buoy 104 may be designed to be powered by one or more renewable energy sources, including, but not limited to, solar, current and wave action systems. In some embodiments, retractable solar panels 126 are fitted to supply adequate system power including battery storage and power distribution. The solar panels are designed to lay open on the ocean surface when conditions are ideal for safe deployment, avoiding times when conditions are potentially harmful to the apparatus. The design allows for unique and larger surface solar arrays since they can be designed for deployment when ocean surface conditions are safe, void of vessel activities and optimum for performance of the panels. The system 100 advantageously enables the deployment of a wider selection of renewable energy technologies and designs by eliminating the harshest conditions of the ocean surface by removing the systems from the surface to a safer depth during prescribed conditions. The renewable energy source may collect energy and use the energy to charge one or more power supplies in the system 100, such as a battery associated with the PPU 102 and/or the variable buoy 104.

In some embodiments, the variable buoy 104 includes a pressure housing 128 configured to connect and/or enclose components including, for example, a communications device 130, a controller 132 (e.g., single board computer (SBC)), and a memory device 134 (e.g., solid-sate hard disk drive (SSHDD)) to support communications between the system 100 and one or more onshore home bases, as well as other designated devices and locations. The communications device 130 may include an iridium transceiver configured to receive and/or transmit data packets to and from a remote communications device (e.g., via satellite communications).

In some embodiments, the pressure housing 128 also includes a power manager 136, such as a renewable power voltage regulator and management system. This power manager 136 may be configured to take in power from the various renewable energy sources (e.g., solar panels 126) and uses it to charge batteries associated with variable buoys 104, 105 and/or the PPU 102. The variable buoy 104 may include on-board sensors 138 for detecting motion, temperature, depth and other parameters used to provide the system with position and condition of the variable buoy 104 and conditions of the ocean surface and subsurface environments. The variable buoy 104 may also include, for example, a connector 140 for securing to another end of the umbilical tether 112.

Figure 4:
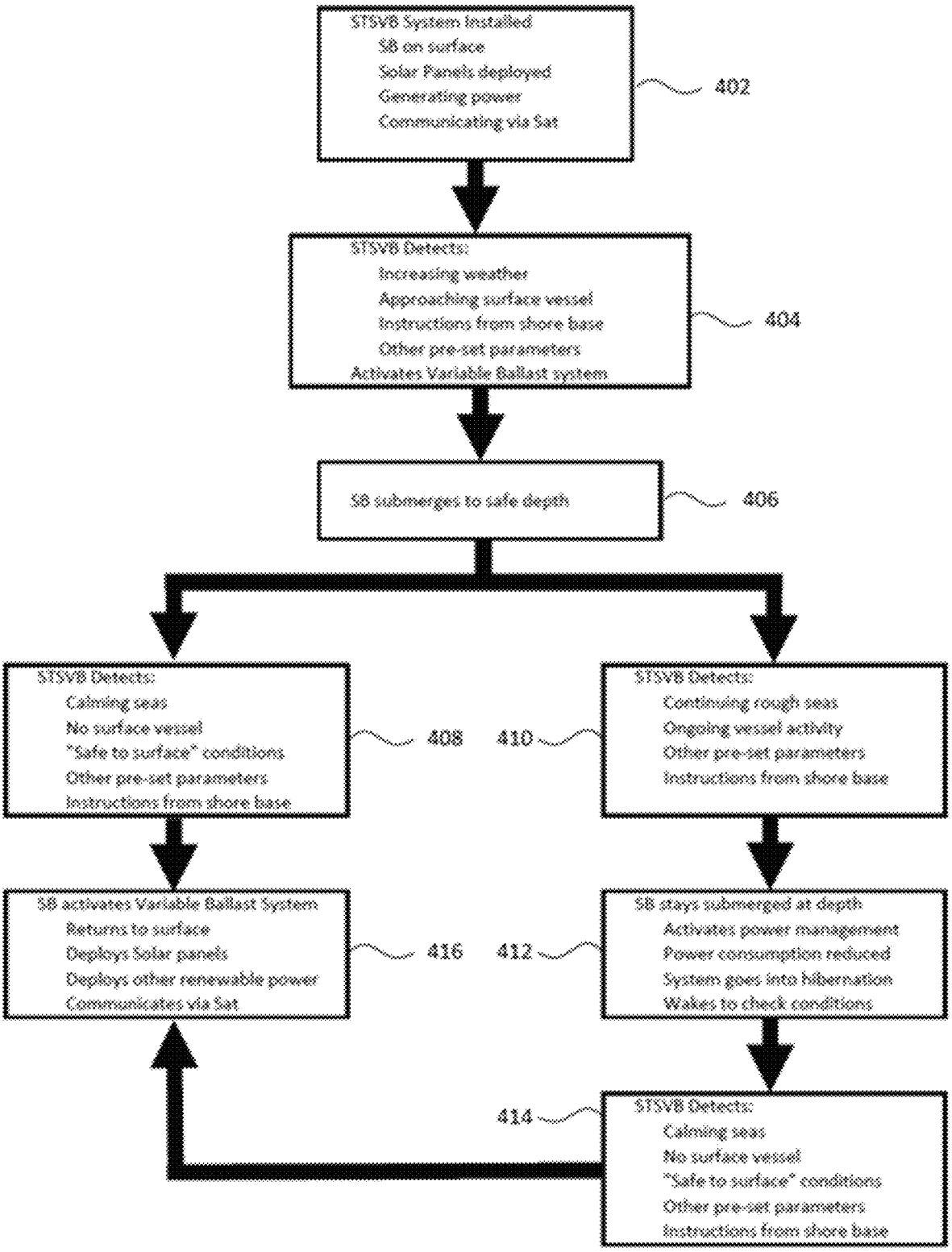
FIG. 4 is a flowchart of an exemplary data capture and transmission process, in accordance with various embodiments.

FIG. 4 is a flow diagram of one example of one example of a method in accordance with some embodiments. As shown in FIG. 4, the system 100 may be installed at block 402. For example, the variable buoy 104 may be positioned on a surface of a body of water. Further, solar panels 126 may be deployed such that power is generated in response to the sun's energy being absorbed by the solar panels 126. The communications device may establish a connection with a remote communications device, such as a satellite, for example.

When deployed, the system 100 may detect one or more first events at block 404. For example, the system 100 may detect, based on data collected from the one or more sensors 106, or on-board sensors 122, 138 such as a change in weather (e.g., an approaching storm) or an approaching vessel. Alternatively or additionally, the system 100 may receive a signal from a remote communications device, such as a satellite or an on-shore base station. The signal may indicate a change in weather, a vessel is approaching, and/or include other instructions for performing a configuration adjustment (e.g., submerging) in response.

At block 406, the system 100 performs a configuration adjustment in response to detecting the one or more first events. As will be understood by a person of ordinary skill in the art, the manner in which the system 100 adjusts or reconfigures may be based on the type of the one or more first events detected. In some embodiments, the variable buoy 104 may submerge to a first depth if the detected one or more first events are of a first type, and the variable buoy 104 may submerge to a second depth, which is different from the first depth, if the one or more detected events are of a second type, which are different from the first type. For example, the variable boy 104 may submerge to a first depth if the detected one or more first events include a change in the weather, and the variable buoy 104 may submerge to a second depth, which is more shallow or deeper than the first depth, if the detected one or more first events include an approaching vessel. A person of ordinary skill in the art will understand that various depths, events, and configuration adjustments may be made.

At block 408, the system 100 detects one or more second events. For example, in some embodiments, the system 100 may detect a change in weather (e.g., the passing of inclement weather) or that the vessel has passed. Alternatively or additionally, the system 100 may receive a signal from a remote communications device, such as a satellite or an on-shore base station. The signal may indicate an event, such as a change in weather, the calming of water indicating that the vessel has passed, and/or include other instructions for performing a configuration adjustment (e.g., to return to the surface) in response to the signal.

At block 410, the system 100 may detect a continuation of the one or more first events based on data obtained from one or more sensors or communication devices or modules. For example, the system 100 may determine or detect that the water continues to be turbulent or rough indicating the continuing of a storm or presence of a vessel. Additionally or alternatively, the system 100 may receive a signal from a remote communications device, such as a satellite or an on-shore base station. The signal may indicate continued inclement weather, vessel presence or activity, and/or include other instructions for maintaining a current configuration.

At block 412, in response to detecting the ongoing event at block 410, the system 100 may maintain its current configuration with respect to its depth location. However, the system 100 may also adjust other parameters in response to detecting the ongoing event. For example, the system 100 may activate a power management protocol, such as for reducing power while in a submerged state. In some embodiments, the power management protocol may include putting the control system into a hibernation/reduced power state for a period of time and periodically waking from the hibernation/reduced power state to determine whether the one or more events of the first type are ongoing. A person of ordinary skill in the art will understand that manner and frequency in which the system hibernates and wakes may be configurable.

At block 414, the system 100 detects one or more second events much like described above with respect to block 408. For example, in some embodiments, the system 100 may detect a change in weather (e.g., the passing of inclement weather) or that the vessel has passed. Alternatively or additionally, the system 100 may receive a signal from a remote communications device, such as a satellite or an on-shore base station. The signal may indicate an event, such as a change in weather, the calming of water indicating that the vessel has passed, and/or include other instructions for performing a configuration adjustment (e.g., to return to the surface) in response to the signal.

At block 416, performs a second configuration adjustment in response to detecting the one or more second events. As will be understood by a person of ordinary skill in the art, the manner in which the system 100 adjusts or reconfigures may be based on the type of the one or more second events detected. In some embodiments, the system 100 may exit out of hibernation and the variable buoy 104 may emerge to the surface by activating the ballast system 124. A person of ordinary skill in the art will understand that various depths, events, and configuration adjustments may be made depending on the particular needs of the system and the outcome of the events as detected by the system sensors.

According to at least some embodiments, an STSVB system is a cost-effective, safe and secure way to collect oceanographic data from various sensors. In some embodiments, the STSVB requires no permanent infrastructure for deployment or operation. Many sampling, survey and monitoring programs benefit from real-time data return to validate operation and augment various modeling efforts. In addition, real-time events can be captured with event notification to clients on a global scale. Types of sensors include, but are not limited to, Met Ocean, acoustic, optical, digital, and analog. In some embodiments, the STSVB systems are dynamic. For example, if an event is detected such as severe weather or vessel traffic the variable buoy can submerge keeping it undetectable and secure. In some embodiments, the STSVB includes retractable solar panels located on the variable buoy. Any additional power not needed by the STSVB sensors is stored and available at a subsea connection. Various other subsea installations can utilize STSVB as a power source by simply plugging into subsea receptacle, allowing the STSVB to function as a renewable energy source of power for remote and seabed systems.

While the foregoing description and drawings represent preferred or exemplary embodiments, it will be understood that various additions, modifications and substitutions may be made therein without departing from the spirit and scope and range of equivalents. In particular, it will be clear to those skilled in the art that the disclosed systems and methods may be embodied in other forms, structures, arrangements, proportions, sizes, and with other elements, materials, and components, without departing from the spirit or essential characteristics thereof. In addition, numerous variations in the methods/processes described herein may be made without departing from the spirit of the disclosure. One of ordinary skill in the art will further appreciate that the disclosed systems and methods may be used with many modifications of structure, arrangement, proportions, sizes, materials, and components and otherwise, used in the practice of the invention, which are particularly adapted to specific environments and operative requirements without departing from the principles of the disclosure. The presently disclosed embodiments are therefore to be considered in all respects as illustrative and not restrictive.

What is claimed is:

1. A system, comprising:

a base configured to sink and anchor the system in water;

at least one sensor configured to capture data while submerged in water;

a processing unit configured to receive data collected by the at least one sensor;

a variable buoy including:

a ballast system configured to vary and maintain a depth of the variable buoy in the water by changing a buoyancy of the variable buoy; and a communication device configured to transmit data to a remote communications device; and at least one tether connecting at least the base, the processing unit, and the variable buoy.

2. The system of claim 1, wherein the processing unit comprises a data storage device configured to store the data collected by the at least one sensor.

3. The system of claim 1, wherein the processing unit further comprises a controller configured to vary and maintain the depth of the variable buoy via the ballast system.

4. The system of claim 3, wherein the ballast system comprises one or more ballast tanks and at least one valve to control a flow of a fluid into and out of the one or more ballast tanks to change and maintain the buoyancy of the variable buoy.

5. The system of claim 1, further comprising a power supply configured to provide power to the ballast system.

6. The system of claim 5, further comprising a renewable energy source configured to receive and store electrical energy to charge the power supply.

7. The system of claim 6, wherein the renewable energy source is a solar panel.

8. The system of claim 7, wherein the solar panel is attached to the variable buoy and is expandable when the variable buoy is at a water surface and retractable for submerging of the variable buoy.

9. The system of claim 1, wherein a first power source of the processing unit is configured to maintain a charge of a second power source of the variable buoy prior to release of the variable buoy.

10. The system of claim 1, wherein the one or more sensors comprises an on-board sensor configured to detect a first event, the first event comprising at least one of a weather event or an approaching vessel.

11. The system of claim 10, wherein the controller is configured to control the ballast system to vary a depth of the variable buoy based on detection of the first event.

12. The system of claim 10, wherein the on-board sensor comprises one or more of an acoustic hydrophone, a wave action sensor, a current meter, an accelerometer, a pressure sensor, and a magnetometer.

13. The system of claim 1, wherein the at least one tether comprises an anchoring tether connecting the base to the processing unit and an umbilical tether connecting the processing unit to the variable buoy.

14. The system of claim 13, wherein the anchoring tether and the umbilical tether are both configured to transmit data between components connected thereto.

15. A variably buoy, comprising:

a controller configured to execute software instructions;

a memory device in communication with the controller, the memory device configured to store data collected from one or more sensors;

a communications device in communication with the controller and configured to transmit the data to a remote location;

a ballast system configured to vary and maintain a depth of the variable buoy in water by changing a buoyancy of the variable buoy;

a power supply to provide power to the controller, the communications device, and the ballast system; and a connector configured to connect the variable buoy to a tether to anchor the variable buoy and receive the data collected from the one or more sensors.

16. The variable buoy of claim 15, further comprising a renewable energy source configured to receive and store electrical energy to charge the power supply.

17. The variable buoy of claim 16, wherein the renewable energy source is a solar panel.

18. The variable buoy of claim 17, wherein the solar panel is attached to the variable buoy and is expandable when the variable buoy is at a water surface and retractable for submerging of the variable buoy.

19. The variable buoy of claim 15, further comprising one or more on-board sensors configured to detect a first event, and wherein the controller is configured to control the ballast system to vary the depth of the variable buoy based on detection of the first event.

20. The variable buoy of claim 19, wherein the one or more on-board sensors comprises one or more of an acoustic hydrophone, a wave action sensor, a current meter, an accelerometer, a pressure sensor, and a magnetometer.

* * * * *